US007008047B2

(12) United States Patent
Conta et al.

(10) Patent No.: US 7,008,047 B2
(45) Date of Patent: Mar. 7, 2006

(54) SUBSTRATE FOR A THERMAL INK JET PRINTHEAD, A COLOUR PRINTHEAD IN PARTICULAR, AND INK JET PRINTHEAD INCORPORATION THIS SUBSTRATE

(75) Inventors: Renato Conta, Ivrea (IT); Enrico Manini, Chiaverano (IT); Angelo Menegatti, Banchette (IT)

(73) Assignees: Olivetti I-Jet S.p.A., Ivrea (IT); Olivetti S.p.A. Group, Ivrea (IT)

( * ) Notice: Subject to any disclaimer, the term of this patent is extended or adjusted under 35 U.S.C. 154(b) by 0 days.

(21) Appl. No.: 10/472,178

(22) PCT Filed: Mar. 18, 2002

(86) PCT No.: PCT/IT02/00163

§ 371 (c)(1),
(2), (4) Date: Apr. 30, 2004

(87) PCT Pub. No.: WO02/074545

PCT Pub. Date: Sep. 26, 2002

(65) Prior Publication Data

US 2004/0183866 A1 Sep. 23, 2004

(30) Foreign Application Priority Data

Mar. 21, 2001 (IT) ..... TO2001A0266

(51) Int. Cl.
*B41J 2/05* (2006.01)
*B41J 2/21* (2006.01)

(52) U.S. Cl. ..... 347/58; 347/43; 347/63

(58) Field of Classification Search ..... 347/43, 347/56–59, 61, 63, 65, 67, 20
See application file for complete search history.

(56) References Cited

U.S. PATENT DOCUMENTS

| | | | | |
|---|---|---|---|---|
| 4,812,859 A * | 3/1989 | Chan et al. | ..... | 347/63 |
| 5,030,971 A * | 7/1991 | Drake et al. | ..... | 347/57 |
| 5,455,610 A | 10/1995 | Harrington | ..... | 347/43 |

FOREIGN PATENT DOCUMENTS

| | | |
|---|---|---|
| EP | 0 845 359 A | 6/1998 |
| EP | 0 913 261 A | 5/1999 |
| EP | 1 080 898 A | 3/2001 |
| WO | WO 01 05595 A | 1/2001 |

* cited by examiner

*Primary Examiner*—Juanita D. Stephens

(57) ABSTRACT

A substrate (10; 110; 210; 310) for an ink jet printhead comprising: at least three slots (12*a,* 12*b,* 12*c*) of elongated shape, oriented parallel to one another lengthwise in a vertical direction (13); three corresponding actuating banks (16*a,* 16*b,* 16*c*); a plurality of drive circuits (18); and a plurality of terminals (21, 21*a,* 21*b*), lesser in number than the ejection actuators (16), connected to the drive circuits (18) for receiving external signals, wherein at least two (12*a,* 12*b*) of the three slots are arranged side by side along the respective long edges in an upper portion (10*a*) of the substrate, and the third slot (12*c*) is arranged in a lower portion (10*b*) of the substrate, and wherein moreover the terminals (21) connected to the drive circuits are arranged in a line along the edges (11*a,* 11*b*) of the substrate (10) parallel to the slots and therefore to this given vertical direction (13). This substrate has a robust structure and is less likely to crack in the zone of the slots.

19 Claims, 5 Drawing Sheets

SUBSTRATE FOR A THERMAL INK JET PRINTHEAD, A COLOUR PRINTHEAD IN PARTICULAR, AND INK JET PRINTHEAD INCORPORATION THIS SUBSTRATE

This is a U.S. National Phase Application under 35 USC 371 and applicant herewith claims the benefit of priority of PCT/IT02/00163 filed on Mar. 18, 2002, which was published Under PCT Article 21(2) in English, and of Application No. TO2001A000266 filed in Italy on Mar. 21, 2001.

TECHNICAL FIELD

This invention relates to a substrate which is employed in the manufacture of ink jet printheads, particularly of the thermal type, and more specifically to a substrate comprising a plurality of ejection actuators for activating the ejection of ink droplets, a plurality of elongated slots or channels for conveying the ink from a tank to the ejection actuators, and a plurality of drive circuits associated with the ejection actuators for addressing them and commanding their activation.

This invention also relates to an ink jet printhead that incorporates a substrate having the above-mentioned characteristics.

BACKGROUND ART

A substrate, like the one described summarily above, constitutes a fundamental component of the structure of an ink jet printhead, and in particular a printhead, also called thermal type, which is operatively based on the principle of activating the emission of droplets by heating the ink contained in the printhead itself.

This substrate has on its surface a plurality of ejection actuators which, whenever the substrate is built into the structure of the relative ink jet printhead, are arranged each adjacent to a corresponding nozzle of the printhead, and are intended to be struck by the ink contained inside the latter-named.

During use of the printhead, these ejection actuators, when they are excited impulsively with an electric current, behave as dot-like heat sources as they generally take the form of micro-resistors.

In this way, the ejection actuators heat rapidly and transfer the heat thus generated to the ink striking the substrate and the actuators themselves causing, in the immediate vicinity of each of these the formation of an ink vapour bubble which, by expanding, results in the emission of an ink droplet through the corresponding nozzle.

In general these substrates are made by way of a complex manufacturing process, starting from a silicon wafer, in which they have built into their structure the ejection actuators or micro-resistors which, as stated above, cause the generation of vapour bubbles, and thus the emission of ink droplets.

These substrates are also made in such a way as to integrate and produce certain parts of the hydraulic circuit whose role is to convey the ink to the micro-resistors, and typically they comprise a slot, made through the thickness of the substrate, which has the function of putting the micro-resistors zone into communication with a tank of the printhead containing a primary store of ink.

These substrates also integrate in their structure the electric tracks and the terminals that connect the ejection actuators with the drive circuits or "drivers" whose role is to drive them, namely to feed them impulsively with the electric current for causing ejection of the ink droplets.

Furthermore, in the most modern and sophisticated embodiments, the substrates can be produced in such a way as to integrate more complex circuitry parts, such as for instance the very drive circuits mentioned above, or significant portions of the latter.

In detail, these drive circuits are made of elements such as transistors, memories, etc., while their function is to selectively drive, in response to given external signals corresponding to a text to be printed, the micro-resistors constituting the ejection actuators, so that they heat up and generate bubbles.

Accordingly, the nozzles corresponding to the micro-resistors activated selectively emit in succession a plurality of ink droplets, so as to obtain, by composition of the print dots formed by the drops of ink, the desired printed text.

It is obvious therefore how the manufacture of these substrates is of great importance in the context of the entire printhead manufacturing cycle.

First and foremost, it is essential that the substrates are produced with great care and precision, and in strict compliance with the technical specifications, in order to guarantee that the printheads on which the substrates are mounted are capable of providing the desired performances and results, both in terms of their service life, and in terms of the printing quality obtainable with the printheads.

Likewise it is essential to produce substrates that are affected by the lowest possible defects rate, both during and at the end of the relative manufacturing cycle, to avoid their being rejected with an obviously negative impact on their production cost.

Various possible arrangements are known for these substrates, in relation both to the type of the printheads, i.e. black or color, on which they are mounted, and to the total number of nozzles included in the heads.

In the case of a color printhead, the nozzles intended for emitting ink droplets of a certain color are usually grouped into one or more banks of nozzles, distinct from the other banks of nozzles corresponding to the other colors, in which each bank of nozzles is easily discernable on the outer surface of the printhead.

In this case too, the ejection actuators are arranged and grouped on the surface of the substrate in corresponding banks, called actuating banks for clarity's sake, adjacent to a respective slot, in such a way that the ejection actuators of each actuating bank can receive the ink of the corresponding color.

Clearly the greater the number of nozzles used, the greater the number of corresponding ejection actuators, and therefore the more complex the structure and configuration of the substrate integrating the ejection actuators and relative drive circuits.

Just to complete the picture, these substrates are manufactured using the typical integrated circuit manufacturing technologies, and are generally made in multiple form starting from a round plate or wafer of silicon, the surface of which is subdivided into a plurality of cells, each corresponding to one substrate.

More particularly, various layers of different materials are deposited on the surface of this plate in successive-steps, before being selectively etched to produce the drive circuits and the ejection actuators.

The slots are then made through the thickness of each of the cells of the substrate, by way of a mechanical operation, such as sand-blasting.

Finally these plates are sub-divided into the elementary cells to form many units, each corresponding to a substrate.

As already said, it is extremely important that these substrates are made compliant with given tolerances, possibly even very stringent ones, so that no defects are revealed during the production cycles, for if this were the case, as already explained, they would be rejected automatically, obviously increasing the production costs.

Unfortunately, it often happens that the configuration adopted for the known substrates has characteristics which, at least potentially, could render the substrate manufacturing cycle particularly critical, and in particular foster the occurrence of defects during the cycle.

For example, a configuration comprising a plurality of slots aligned exactly with one another, in the lengthwise direction, tends to render the substrate particularly fragile local to the zones of separation between the slots.

In actual fact, with this configuration it is easy—potentially at least—for the substrate to break or for cracks to form along the zones of separation in a direction parallel to that of the slots.

Furthermore, by adopting a configuration of this type, with the slots aligned longitudinally, it becomes extremely important to limit as much as possible the extent of the zones of separation between the slots, in order to reduce the overall dimensions lengthwise, and thus the cost, of the substrate, and indeed also to limit the total cost of the printhead.

On the other hand, excessively reducing the zones of separation between the slots renders especially critical and delicate, and therefore easily subject to defects, the operation of hermetical sealing, local to these zones, between the hydraulic circuits intended for conveying the different color inks, i.e. that sealing operation the object of which is to avoid the various hydraulic circuits of the printhead, each corresponding to a given slot and to a given color ink, coming into communication with one another.

In fact, as will be easily understood, it is extremely critical during the assembly of the printhead to perform the operation of hermetical sealing in the zones of separation between the slots, where these zones are of limited extent.

Thus a configuration of a substrate in which the slots are aligned longitudinally is clearly not capable of optimally satisfying the conflicting requirements outlined above.

Also known from U.S. Pat. No. 5,030,971 is a substrate having a plurality of slots for the passage of ink, which extend parallel to one another in a given direction, a plurality of actuators arranged along the edges of the slots, a plurality of drive circuits, connected to the actuators, which occupy portions of the surface of the substrate extending parallel and adjacent to the slots, and a plurality of terminals, for driving the drive circuits, which are arranged in a zone above and beneath the slots and are also aligned in a direction perpendicular to the given direction of extension of the slots and drive circuits.

This configuration, though it avoids having the slots arranged in a row lengthwise, is not entirely free of drawbacks, and for instance has the terminals in not necessarily the most convenient or optimal configuration, for the purpose for instance of assembling the various parts comprising the printhead that the substrate is built into.

In particular, the terminals of this substrate, aligned in a direction perpendicular to the orientation of the slots and arranged in a zone above and beneath the rows of nozzles, could imply a somewhat tortuous and complicated configuration of the tracks of the flexible cable connecting the terminals to the corresponding contacts, arranged on the surface of the printhead, the function in turn of which is to electrically connect the latter with the outside, and in particular with the control circuit of the printer that the printhead is removably fitted in.

DISCLOSURE OF INVENTION

One object therefore of this invention is to produce a substrate for an ink jet head capable of surmounting the above-mentioned drawbacks of the substrates known today.

More particularly, an object of this invention is to produce a substrate with a plurality of ejection actuators and a corresponding plurality of terminals suitable for receiving signals for activating the actuators, in which the terminals are arranged in a configuration capable of permitting an optimal connection between the terminals and the contacts intended for electrically connecting the printhead that the substrate is incorporated in with the outside.

This object is achieved by the substrate for an ink jet printhead having the characteristics defined in the main independent claim.

Another object of the invention is to produce a substrate, intended for the manufacture of ink jet printheads, which has an extremely low defect rate during the relative manufacturing cycle, and which in particular has a highly robust structure that is less liable to cracking, in the zone of separation of the slots for the flow of ink, than the substrates known today.

A further object is to produce an ink jet printhead, in particular color type, having a manufacturing process in which both the operation of separating and of hermetical sealing between the different hydraulic circuits intended for conveying the different color inks can be carried out with a higher degree of efficiency and quality with respect to the known heads having the ducting slots aligned in a row along the lengthwise direction.

BRIEF DESCRIPTION OF DRAWINGS

The head 50 is typically of the color type and is adapted for ejecting droplets of various colors, formed from color inks, to produce color prints on the printing medium 59 according to widely known printing arrangements.

BEST MODE FOR CARRYING OUT THE INVENTION

Figure 1:
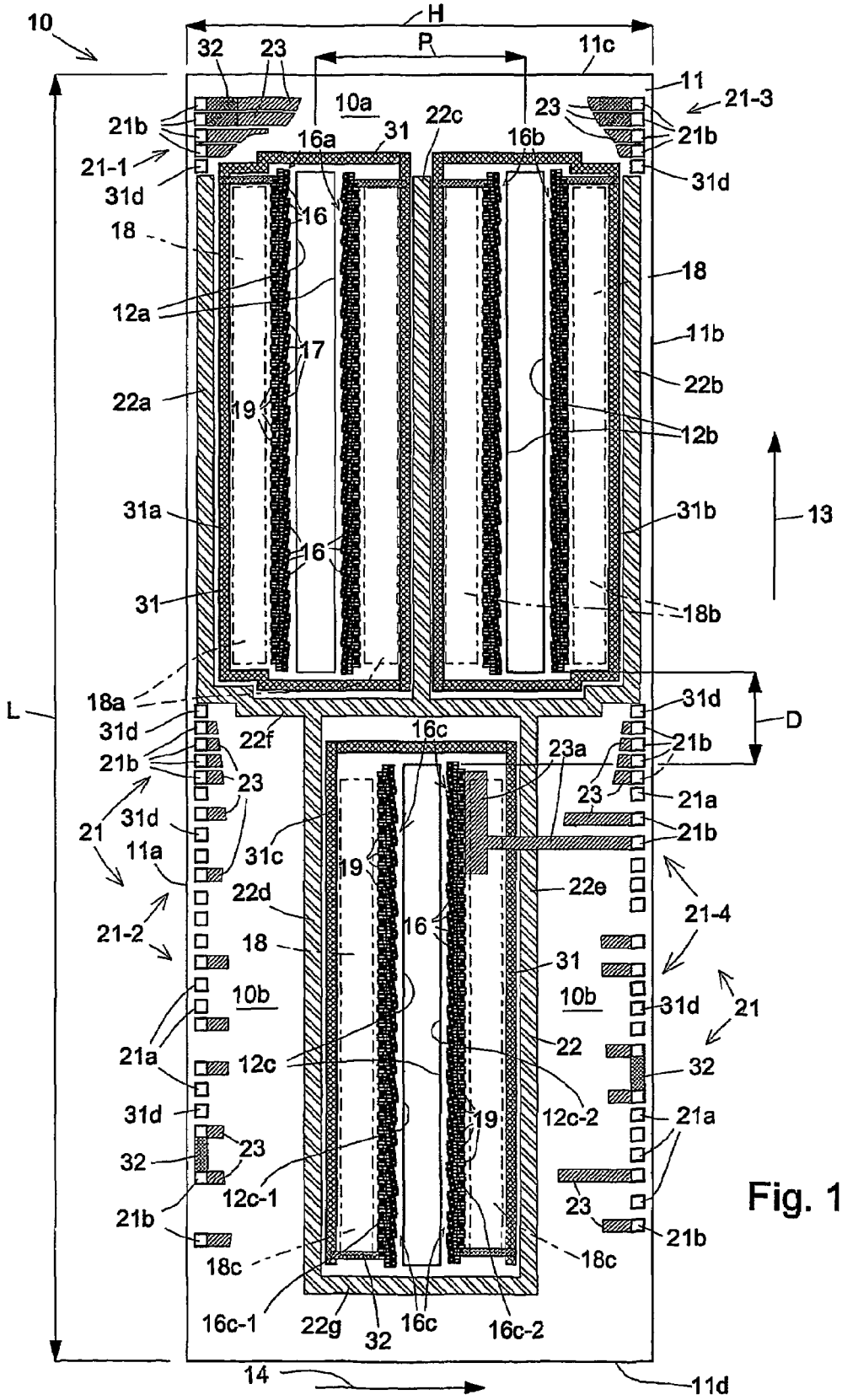
FIG. 1 is a plan view of a first embodiment of a substrate for a thermal ink jet head made according to this invention, having three vertical slots arranged in a Y configuration.

With reference to FIG. 1, a substrate suitable for use in manufacturing an ink jet printhead and having a configuration according to this invention is generically designated with the numeral 10.

The substrate 10 of the invention is represented in plan view in FIG. 1, and comprises a wafer 11 of silicon of a generically rectangular shape having length L and width H, with a left side 11*a*, a right side 11*b*, an upper side 11*c* and a lower side 11*d*. In general the length L, defined by the sides 11*a* and 11*b*, is greater than the width H, defined by the sides 11*c* and 11*d*.

The long sides 11*a* and 11*b* define a vertical or longitudinal direction, corresponding to the arrow 13, of the substrate 10, whereas the short sides 11*c* and 11*d* define a horizontal or transversal direction, corresponding to the arrow 14, of this substrate 10.

As anticipated above, this substrate 10 represents an essential component for the manufacture of an ink jet printhead, in particular of the type working on the principle of cyclically heating the ink contained in the head before emitting a plurality of ink droplets, and on this account also called thermal ink jet head.

Figure 5:
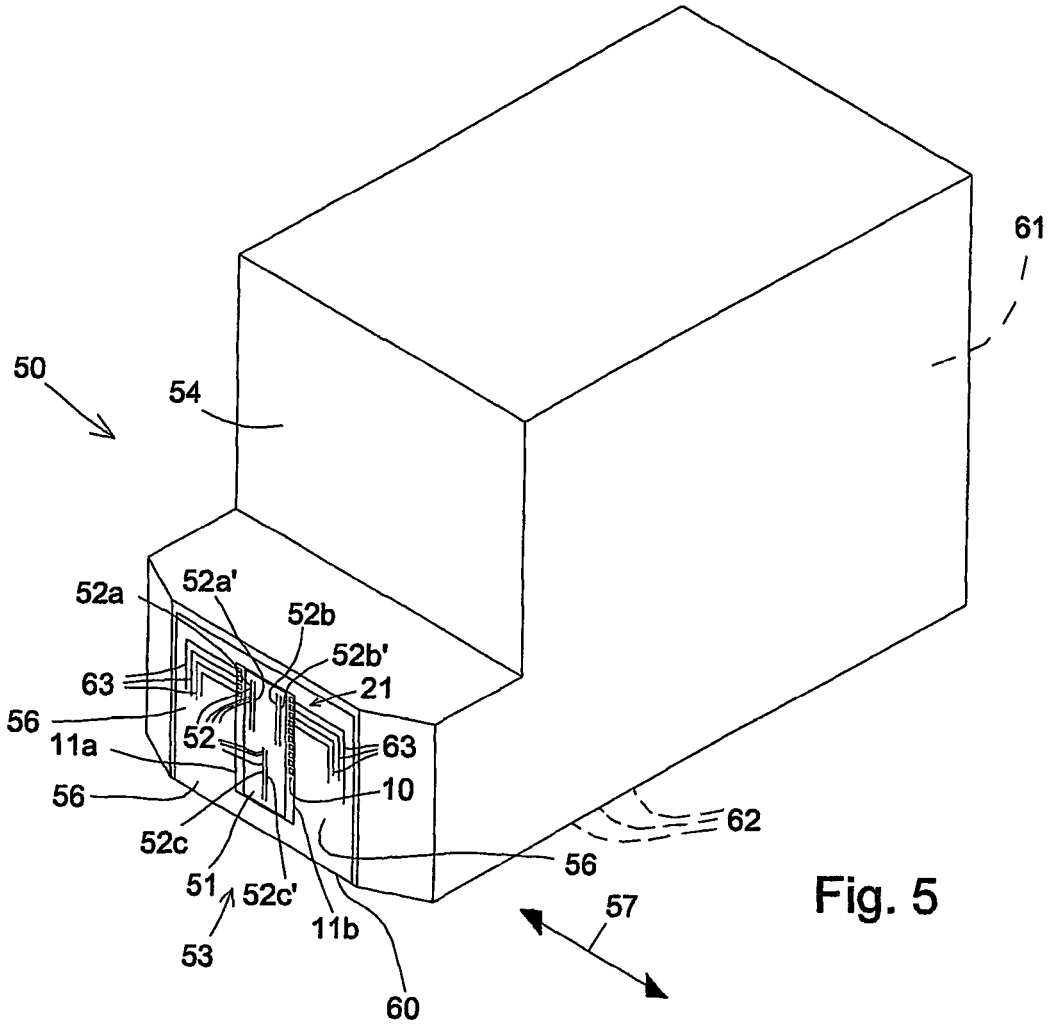
FIG. 5 is a perspective view of an ink jet printhead incorporating the substrate of FIG. 1.
Figure 6:
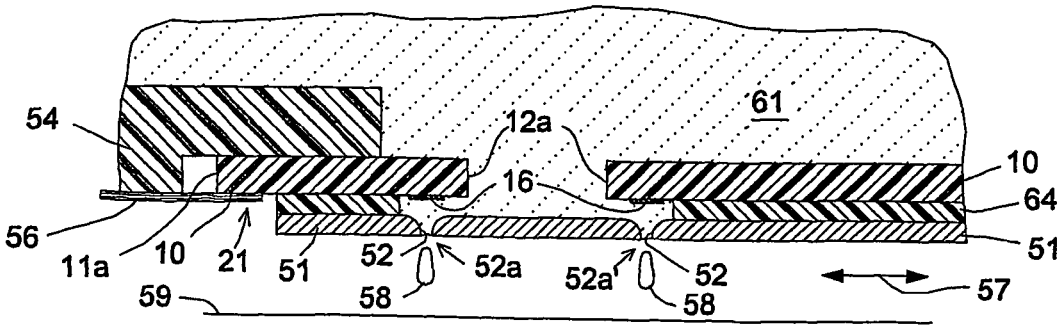
FIG. 6 is a sectioned and enlarged view of a limited front zone of the printhead of FIG. 5.

For clarity's sake, a printhead of this type, incorporating the substrate 10, is depicted in general in a perspective view in FIG. 5, where it is designated with the numeral 50, and in greater detail in a limited area in FIG. 6.

The head 50 is provided with an outer shelf 54 containing inside a volume of ink 61, and a nozzle plate 51, which in turn comprises a plurality of nozzles 52 suitable for ejecting ink droplets 58 on a printing medium 59, such as a sheet of paper, for printing symbols, characters and images on the latter-named.

The head 50 is typically of the colour type and is adapted for ejecting droplets of various colours, formed from colour inks, to produce colour prints on the printing medium 59 according to widely known printing arrangements.

In a first step, when the substrate 10 is still not incorporated in the printhead 50, a layer 64 of a suitable material, such as a photopolymer, is coupled by lamination on the surface of the substrate 10, and then etched by means of a known process, for instance photoetching, in order to reproduce the hydraulic circuit suitable for conveying the ink 61 to the actuators 16.

Subsequently the nozzle plate 51 is secured on the layer 64, and accordingly made integral with the substrate 10, so that the nozzles 52 are arranged exactly in correspondence with the actuators 16.

Finally the substrate 10 is secured on the outer shell 54 in correspondence with a front side 53 of the printhead 50, which, when in use, is arranged facing the printing medium 59 for ejecting on the latter-named the droplets 58 of ink, as illustrated in FIG. 6.

The substrate 10 is arranged on the printhead 50 with the long sides 11*a* and 11*b* oriented perpendicular to the printing direction, indicated by the arrow 57, according to which the printhead 50 moves forward and back in front of the printing medium 59, during the printing step, for ejecting the ink droplets.

Therefore the arrow 14 which defines the horizontal direction of the substrate 10 is parallel to the motion assumed by the printhead 50, during the printing motion, while the arrow 13, which defines the vertical direction of the substrate 10, is disposed transversally to the direction of the printing motion.

Now, to go back to FIG. 1, the substrate 10 is made according to a widely known process and not therefore described in detail herein starting from a silicon wafer, generally circular in shape, subdivided into a plurality of elementary areas each corresponding to a substrate 10 to be manufactured.

In particular, this silicon wafer is subjected to a series of work steps, in correspondence with the various elementary areas, such as the deposition of certain layers of materials on the surface of the wafer, the subsequent etching of these layers, and the formation of through slots in each of the elementary areas.

Finally, at the end of the manufacturing process, the wafer is cut along the edges of the various elementary areas so as to form a plurality of substrates 10, such as the one depicted in FIG. 1.

Inside the rectangular perimeter of the wafer 11, the substrate 10 comprises three slots 12*a*, 12*b*, and 12*c* of elongated shape and formed in such a way as to fully traverse the thickness of the wafer 11.

These slots 12*a*–12*c* may be made using various techniques during manufacture of the substrate 10, for example by selectively etching the surface of the wafer 11 by means of a sand-blasting process.

Within the printhead 50 in which, as already stated, the substrate 10 is incorporated, each of the three slots 12*a*–12*c* has the function of conveying a corresponding color ink coming from an ink reserve, in turn accommodated inside the shell 54 of the printhead 50.

For example, the three slots 12*a*–12*c* are arranged for receiving respectively a magenta ink, a cyan ink and a yellow ink from respective and distinct main tanks provided in the printhead 50, and for conveying these color inks to the zone of the nozzles 52, so that they are selectively ejected in the form of droplets and thus form upon the printing medium, by composition of the color dots corresponding to the droplets emitted, color symbols, characters and images.

In particular, the slots 12*a*–12*c* are arranged for receiving the color inks from the respective tanks through corresponding hydraulic circuits hermetically separated from one another, so as to avoid all forms of contamination between one ink and another.

These hydraulic circuits comprise various elements such as micro-ducts, chambers, filters, of appropriate dimensions to ensure correct feeding of the inks from the respective tanks to the nozzles zone.

Even if the substrate 10, on account of there being numerous slots, is typically intended for being applied in a color printing context, for use with various color inks, it may also be used on a black and white type head, or a mixed type head capable of both black and color printing, in which case one or more of the slots 12*a*–12*c* may be arranged for conveying black ink.

The three slots 12*a*–12*c* extend in the longitudinal direction parallel to the long sides 11*a* and 11*b* of the wafer 11, and therefore according to the vertical direction defined by the arrow 13, each one comprising two long sides or edges, opposite and parallel as also is the arrow 13, and two short edges defining an upper and a lower end of the slot.

For the sake of clarity, only the two long opposite sides of the slot 12*c* are indicated in FIG. 1, respectively with 12*c*-1 and 12*c*-2.

The three slots 12*a*–12*c*, which are of substantially the same length longitudinally, are formed on the surface of the wafer 11 in such a way as to define a Y-shape configuration, in which the two slots 12*a* and 12*b* are arranged in an upper semi-portion 10*a* of the substrate 10, perfectly in a line one beside the other along the respective long sides and parallel to the direction 13, whereas the third slot 12*c* is arranged in a lower semi-portion 10*b* of the substrate 10 and is displaced, parallel to the direction 13, with respect to the couple formed by the other two slots 12*a* and 12*b* by a distance at least equal to or greater than the length of the latter-named.

More precisely, on observing the substrate 10 according to the direction 14, the upper slots 12*a* and 12*b* are arranged perfectly aligned and one in the shadow of the other, whereas the slot 12*c* is arranged completely displaced with respect to the slots 12*a* and 12*b*, with the upper end or edge of slot 12*c* positioned, in the direction 13, at a given distance D from the lower ends of the slots 12*a* and 12*b*.

Furthermore, if we observe the substrate 10 parallel to the direction 13, the slot 12*c* is arranged according to the Y-shape configuration in an intermediate position between the slots 12*a* and 12*b*, i.e. at about half of the pitch P, measured in direction 14, between the two slots 12*a* and 12*b*.

The substrate also comprises three actuating banks, generically designated 16*a*, 16*b*, and 16*c*, corresponding respectively to the three slots 12*a*, 12*b* and 12*c*, in which each actuating bank is composed of a plurality of actuators 16 arranged around the corresponding slot and made in turn of micro-resistors.

Each actuating bank, in sequence 16*a*, 16*b* and 16*c*, is divided into two rows, which are arranged each along a respective long edge of the corresponding slot, i.e. 12*a*, 12*b*, and 12*c*.

For the sake of clarity, only the two rows of the actuating bank 16*c*, which are arranged respectively along the edge 12*c*-1 and 12*c*-2 of the slot 12*c*, are indicated respectively with 16*c*-1 and 16*c*-2.

As may be seen in FIG. 1, the various rows formed by these actuators 16 extend practically along the entire length of the long opposite edges of the corresponding slots 12*a*–12*c*, at a very short distance from these edges, and therefore assume an extension in the longitudinal direction which is practically the same for all the rows of actuators.

The different rows of actuators, which make up the actuating banks 16*a*, 16*b* and 16*c* and which are formed along the edges of the slots 12*a*–12*c*, are in turn subdivided into elementary groups, designated with the numeral 17 and, for instance, each made up of three or four aligned and adjacent actuators, in which these groups are arranged in succession, but which are slightly slanting one with respect to the other.

This configuration of the actuators 16, also termed "staggered" configuration, has in particular the purpose of avoiding the actuators 16, adjacent to one another, being excited simultaneously, with the resultant danger of causing disturbance and interference of a hydraulic nature, the so-called hydraulic intermodulations, between two nearby nozzles, during operation of the printhead 50 incorporating the substrate 10.

In fact, with this slanting group disposition, the actuators 16 arranged adjacently in each actuating bank 16*a*–16*c* are always slightly staggered in the direction 14, corresponding in turn to the direction of motion of the head 50, so that two actuators 16, arranged close to one another, transit at different times in front of an ideal line parallel to the direction 13, and must not therefore be excited simultaneously to print two dots lying in this direction 13.

The arrangement of the nozzles 52 on the surface of the nozzle plate 51 exactly reproduces the arrangement of the actuators 16 on the long opposite sides of the slots 12*a*–12*c* of the substrate 10.

Accordingly, as shown in FIG. 5, the nozzles 52 of the plate 51 define a Y-shape configuration formed by three pairs of rows of nozzles, in which each pair of rows of nozzles corresponds to one slot of the substrate 10.

In particular, the first pair is formed by the rows 52*a* and 52*a*' of nozzles, and corresponds to the slot 12*a*, the second pair is formed by the rows 52*b* and 52*b*' and corresponds to the slot 12*b*, and the third pair is formed by rows 52*c* and 52*c*' and corresponds to the slot 12*c*.

When the head 50 incorporating the substrate 10 is in use, the actuators 16, made as stated of micro-resistors, are struck by the ink conveyed by the slots 12*a*–12*c* and are selectively heated impulsively, so as to bring the ink that is in their immediate vicinity rapidly to boiling point.

In this way; each actuator 16 excited results in the formation, in its immediate vicinity, of a bubble of ink vapour which, in turn, by expanding, compresses the ink disposed in the zone about the excited actuator, thereby determining a wave of pressure that causes the ejection of an ink droplet through the nozzle corresponding to that excited actuator.

The substrate 10 also comprises a plurality of drive circuits, also called drivers and designated with the numeral 18 in FIG. 1, which are arranged for controlling each actuator 16 in a selective way through suitable control signals.

In particular, the tracks that connect the drive circuits 18 with the various actuators 16 are designated with the numeral 19, and constitute a very dense network, represented only in part and by way of example in FIG. 1, wherein the various connection tracks 19, without interfering with one another, perform the function of carrying the control signals to each actuator 16.

For simplicity's sake, these drive circuits 18 are not represented in detail but merely schematically in a dot and dash line, and are generically subdivided into three portions, respectively 18*a*, 18*b* and 18*c*, each arranged about a corresponding actuating bank, in the order 16*a*, 16*b* and 16*c*.

In particular each portion 18*a*, 18*b* and 18*c* of the drive circuits 18 extends on the surface of the substrate 10 adjacently to and at opposite ends with respect to the corresponding actuating bank 16*a*, 16*b* and 16*c*, but in an area slightly further away from the relative slots 12*a*, 12*b* and 12*c*.

In this way, the various portions 18*a*, 18*b* and 18*c* of the drive circuits 18 assume a generically rectangular shape, and are arranged parallel to and around the rows of actuators 16 placed along the long edges of the slots 12*a*–12*c*.

These drive circuits 18 possess known characteristics and are substantially made of a multiplicity of transistors or equivalent circuits, or other elementary circuits, in particular suitable for being addressed to work as switches and/or breakers.

The drive circuits 18 are made on the surface of the substrate 10 with processes that are also widely known, for instance by depositing and selectively etching one or more layers of certain materials, and typically using technologies consolidated for making integrated circuits.

Therefore these drive circuits 18 will not be described in detail, their characteristics and features being widely known to those acquainted with the sector art.

It is merely pointed out that, as will be better understood in the following, the components of these drive circuits 18 are reciprocally interconnected so as to define a matrix structure through which to address and therefore selectively drive the various actuators 16 with a low number of signals, and with a corresponding low number of terminals made on the substrates 10.

The substrate 10 also comprises a plurality of terminals, generically designated with the numeral 21 and also called "pads", which are electrically connected to the drive circuits 18 and are arranged along the vertical sides 11*a* and 11*b* of the substrate 10 for receiving from the outside the signals intended for selectively driving the actuators 16, as will be better described in the following.

For this purpose, each terminal 21 is associated with a corresponding track for transmitting the signals received to the various circuits of the substrate 10.

These terminals 21 are defined by the grid-like structure of the drive circuits 18 and are therefore considerably lesser in total number than the actuators 16.

In particular, the terminals 21 are divided into a first and a second addressing group in which, as in a grid, the terminals belonging to the first addressing group and the terminals belonging to the second addressing group are suitable for defining in combination and unambiguously each actuator 16.

For the sake of clarity and simplicity, the terminals 21 of the first addressing group are designated with the numeral 21*a* and are represented alone without the corresponding track, while those of the second addressing group are designated with 21*b* and are represented with at least a portion of the corresponding track, in turn drawn with a dashed line at 45° and uniform step.

As can be seen, the terminals 21*a* and 21*b* of the two groups are arranged in alternation along the vertical sides 11*a* and 11*b* of the substrate 10.

In greater detail, the terminals 21*a* and 21*b* of each addressing group are arranged for receiving as input, from the control circuit of the printer that the head 50 is mounted on, the signals that selectively command the actuators 16 by means of the drive circuits 18.

In this way, the actuators 16 of the various actuating banks can be selectively addressed and driven through a combination of two signals sent to the terminals 21, so that, as already said, the number of terminals 21 actually needed to drive the actuators may be much less than that of the terminals 21 themselves.

For example, a given actuator 16 may be unambiguously addressed and commanded through a first and a second input signal, in which the first signal is sent to a given terminal 21*a* belonging to the first addressing group, and the second signal is sent to another terminal 21*b* belonging to the second addressing group.

The signals received by terminals 21*a* are essentially logic type, i.e. characterized by currents of very feeble intensity, and generally have the function of enabling the ports of the transistors that comprise the drive circuits 18 in order to selectively address the actuators 16.

The signals passing through the terminals 21*b*, on the other hand, correspond to the power which is absorbed by the actuators 16 when they are activated and are thus characterized by current levels that are much higher than the signals fed to the terminals 21*a*.

On the surface of the substrate 10, the terminals 21 are divided into four groups or portions designated respectively with numerals 21-1, 21-2, 21-3 and 21-4, with the portions 21-1 and 21-2 arranged on the left side 11*a*, and the portions 21-3 and 21-4 arranged on the right side 11*b*.

The terminals 21*a* belonging to the first addressing group are connected to the drive circuits 18 through a plurality of tracks or lines, also called "buses", which are grouped and arranged one beside the other so as to define bunches 22 of tracks.

These bunches of tracks 22 are schematically represented in FIG. 1 with a dashed line formed by slanting lines in groups of two, and extend in a direction parallel to the edges of the substrate 10.

Having to transmit logic type signals therefore characterized by low power levels, the tracks comprising the bunches 22 are reduced in width with respect to the tracks, described in greater detail later, which transmit the through signals via the terminals 21*b*.

The bunch of tracks 22 is made in a first metallization process and subsequent selective etching on a lower layer of the substrate 10, upon which other layers will be deposited to produce other circuits, as will be better described in the following.

These bunches of tracks 22 comprises five main rectilinear portions, indicated 22*a*, 22*b*, 22*c*, 22*d* and 22*e*, which extend adjacent and parallel to corresponding portions of the drive circuits 18 in the vertical direction 13, in which in particular the portion 22*a* separates, on side 11*a*, group 21-1 from group 21-2 of terminals 21*b*, whereas the portion 22*b* separates, on side 11*b*, group 21-3 from group 21-4 of terminals 21*b*.

The bunches of tracks 22 also comprise portions 22*f* and 22*g* oriented parallel to the direction 14 for connecting the vertical portions of the bunches 22 to one another.

In this way, the bunches of tracks 22 permit the signals received by the terminals 21*a* to reach those components of the drive circuits 18 adapted for driving the actuators 16 selected in function of the printing program that controls emission of the droplets.

In turn, the terminals 21*b* of the second addressing group are connected with the drive circuits 18 through a plurality of other tracks, indicated 23, which, as already anticipated, are characterized by the fact that they are of greater width than the tracks, described above, defining the bunches 22.

In actual fact, the tracks 23 generally have the function of transmitting the currents and therefore the power absorbed by the resistors that constitute the actuators 16, when they are heated impulsively to determine ejection of the droplets.

These tracks 23 are partially represented in FIG. 1 with a dashed line of uniform step at 45 degrees and are made by the selective etching of a metallic layer, in turn deposited in a second metallization process above the layer corresponding to the bunches of tracks 22, after being suitably isolated from the latter.

In this way, the tracks 23 run above the tracks of the bunches 22 in such a way that they straddle them without creating short-circuits with them.

In particular the tracks 23 each extend between a corresponding terminal 21*b* and a zone adjacent to the row of actuators 16, where the tracks 23 widen, forming a T-shape end, so as to connect to the common terminals of a group of adjacent resistors which make up the actuators 16.

For simplicity's sake, only one of these tracks, indicated with 23*a*, is illustrated in full in FIG. 1.

As can be seen, the track 23*a* extends on top of the bus 22 between the relative terminal 21*b* and the zone of the actuators 16, where the track 23*a* assumes, as said, a greater width than the remaining portion adjacent to the terminal 21*b*, so as to connect to the common point of a large number of actuators 16.

The terminals 21*b* are variously positioned along the sides 11*a* and 11*b* of the substrate 10.

For example, four terminals 21*b* constitute the portion 21-1, of which two are connected with two respective groups of actuators 16 arranged on the left side of the slot. 12*a*, and the other two are connected with two respective groups of actuators 16 arranged on the right side of the slot 12*a*.

Similarly four terminals 21*b* constitute the portion 21-3, of which two are connected with two respective groups of actuators 16 arranged on the left side of the slot 12*b*, and the other two are connected with two respective groups of actuators 16 arranged on the right side of the slot 12*b*.

Other terminals 21*b* are placed on the sides 11*a* and 11*b* under the portions 22*a* and 22*b* of the bunches 22 and are connected with the remaining groups of actuators 16, adjacent to the slots 12*a* and 12*b*, which are not connected with the terminals 21*b* mentioned above and constituting the portions 21-1 and 21-3.

Accordingly, the terminals 21*b* corresponding to the actuators 16 adjacent to the two slots 12*a* and 12*b*, arranged in the upper portion 10*a* of the substrate 10, are disposed symmetrically on top of and under each slot 12*a* and 12*b*, so as to allow the tracks 23 which feed the actuators 16 of the slots 12*a* and 12*b* to extend according to regular, limited paths.

As demonstrated in FIG. 5, in the structure of the head 50, the terminals 21 are electrically connected via a flexible cable 56 with a plurality of contacts or pads 62 arranged on an outer side, not shown, of the head 50, which is oriented according to a plane perpendicular to the front side 53.

In particular, the flexible cable 56, also called "flat cable", defines a plurality of tracks 63 which connect each terminal 21 with a corresponding pad 62. In addition, the flexible cable 56 is glued on the surface of the shell 54, both on the front side 53 and on the side not in view bearing the contacts 62, and is bent in correspondence with an edge 60 arranged between these two sides.

When the printhead 50 is fitted in the relative printer, the pads 62 are provided for connecting with corresponding contacts arranged in the suitable seat of the printer in which the printhead 50 itself is removably accommodated.

In this way, as already said, the terminals 21 can receive the signals sent by the printer control circuit, before addressing them through the tracks 22 and 23 to the drive circuits 18 and, as a result, selectively activating the actuators 16.

The substrate 10 also comprises an earth network 31 which is represented with a crisscross dashed line and is made up of a multiplicity of portions, indicated by way of example with 31*a*, 31*b*, 31*c*, which are interconnected with one another, and which run along the surface of the substrate 10 between the various slots 12*a*–12*c*.

This earth network 31 has essentially the function of conveying feedback currents generated during activation of the actuators 16 to the outside of the substrate 10 and is connected with corresponding earth terminals, indicated with 31*d*, arranged along the edges of the same substrate 10.

For example, as can be seen in FIG. 1, two earth terminals 31*d* may be arranged respectively in an upper zone of the side 11*a* and in an upper zone of the side 11*b*, between the group of adjacent terminals 21*b* constituting the portions 21-1 and 21-3 and the portions 22*a* and 22*b* of the bunches 22 arranged on the sides 11*a* and 11*b*.

Other earth terminals 31*d* may be variously arranged along the lower zones of the sides 11*a* and 11*b*, not occupied by the bunch 22, between terminals of type 21*a* and 21*b*.

Furthermore the substrate 10 comprises a plurality of protecting elements, indicated with 32 and represented with dark-filled areas, which are suitably arranged in numerous zones of the substrate 10 for the purpose of protecting the various circuits, and most particularly for avoiding the accidental overvoltages and electrostatic discharges which could damage these circuits.

In particular, the protecting elements 32, depicted only in part and by way of example in FIG. 1, are arranged along the edges 11*a* and 11*b* between each terminal 21 and the one adjacent thereto, and are connected at one end with the track they have to protect and at the other end with the earth network 31.

From what has been described above, it transpires that one notable aspect of this substrate lies in the disposition and orientation of the lines of terminals 21 with respect to the slots 12*a*–12*c* arranged for conveying the ink, and in the corresponding actuating banks 16*a*–16*c*.

In particular, in accordance with this disposition, extensive portions of the bunches 22 of tracks of a length corresponding to that of the upper slots 12*a* and 12*b* extend immediately adjacent to the vertical sides 11*a* and 11*b*, and therefore in a direction parallel to the slots 12*a*–12*c*, whereas the terminals 21*a* and 21*b* which define the driving grid of the actuators 16 are arranged on the remaining zones, not occupied by the bunches 22, of the edges 11*a* and 11*b*.

Thanks to this configuration, the substrate 10 may to advantage be produced with a low value of width H.

Moreover, the terminals 21*b* which receive the power signals for the actuating banks 16*a* and 16*b* adjacent to the upper slots 12*a* and 12*b* are arranged symmetrically, partly in an upper zone and partly in a lower zone, with respect to the slots 12*a* and 12*b* and as close as possible to them, and therefore to the corresponding actuating banks 16*a* and 16*b*. In this way, the tracks 23, having a T-shape end, that connect the terminals 21*b* with the groups of actuators 16 adjacent to the slots 12*a* and 12*b* assume as reduced an extension as possible and one that is therefore optimal in terms of the dissipation of energy and quality of the signals transmitted.

In turn, the terminals 21*a* adapted for receiving the logic signals for addressing of the actuators 16 of the actuating banks 16*a*–16*c* adjacent to the three slots 12*a*–12*c* are arranged, in alternation with terminals 21*b* associated with the actuating bank 16*c*, at opposite ends with respect to the latter-named slot 16*c* and along lower portions of the opposite ends 11*a* and 11*b* having an extension substantially corresponding to that of the slot 12*c*.

In this way, also the length L of the substrate 10 may to advantage assume a low value with respect to the substrates of the known art.

Some information will now be given about the real dimensions, in accordance with which the substrate 10 of the invention may be manufactured.

For example, each actuating bank 16*a*, 16*b* and 16*c* may be made of 136 resistors or actuators 16, and be arranged in two equal rows, each therefore comprising 68 actuators, on the edges of the corresponding slot, giving a total of 136×3=408 actuators and correspondingly of 408 nozzles in the head incorporating the substrate 10.

In each actuating bank, the 68 actuators of each row are arranged in a line in a vertical direction according to a step equal to 1/300 of an inch, also indicated 1/300", i.e. equal to 0.0846 mm, whereas the two rows are staggered still in the vertical direction by a distance equal to one half of the step between the actuators of each row.

Accordingly the actuators of the two rows considered as a whole are reciprocally staggered according to a step of 1/600" in the vertical direction.

In this way, the actuators 16 of each actuating bank 16*a*–16*c* and the corresponding ejection nozzles 52 are capable of printing with a printing resolution of 1/600", when the printhead 50 moves during its printing stroke in a direction parallel to the arrow 57, with the actuating banks 16*a*–16*c* oriented perpendicular to this printing motion.

With the above assumed dimensions, each actuating bank has a length vertically equal to about 0.0846 mm×67=5.7 mm.

The distance D that separates, in the vertical direction 13, the two upper slots 12*a* and 12*b* from the lower slot 12*c*, and therefore the two actuating banks 16*a* and 16*b* from the actuating bank 16*c*, may be between 0.45 and 0.95 mm.

So, assuming as above that we have a step between actuator and actuator 16 of 1/300 of an inch, the length L of the substrate 10 assumes a value of about 15 mm.

The number of terminals 21 that may be arranged along the two sides 11*a* and 11*b* of the substrate 10 can be variable, depending on the characteristics of the drive circuits 18, on their grid structure, and on the number of actuators 16 to be commanded.

For example, as already anticipated and illustrated in FIG. 1, the terminals 21 may be divided, on each side 11*a* or 11*b*, into an upper group and a lower group separated by a portion of the bunch 22 of lines, in which the upper group is made up of a certain number, for example four, of terminals of type 21*b* and is arranged adjacent to an end of the respective side 11*a* or 11*b*, and the lower group is made up of a greater number of terminals 21, both of the type 21*a* and of the type 21*b*.

It must however be pointed out that, while taking into account the portion of the edges 11*a* and 11*b* occupied by the lines, the remaining length of the edges 11*a* and 11*b* is more than sufficient to support a suitable number of terminals for control of the actuators 16.

The terminals 21 may be divided into two addressing groups, each consisting of 24 and 18 terminals, thus defining a 24×18 type grid and allowing to address, by combining two signals received by two terminals belonging respectively to the first and to the second group, a maximum of 24×18=432 actuators 16.

With the above-mentioned values for the number of actuators 16, and for their step, the substrate 10 assumes a considerably more reduced area than that of the known substrates bearing a roughly equivalent number of actuators.

The substrate 10 with the three slots 12*a*, 12*b* and 12*c*, and with the actuators 16 divided into three groups arranged along the opposite sides of the respective slots, may be used for manufacturing a color ink jet printhead capable of operating with a print definition of 1/600 of an inch, in which in particular the actuators 16 of the first group of actuators arranged along the sides of the slot 12*a* are provided for commanding the ejection of droplets of a first color, the actuators of the second group arranged along the sides of the slot 12*b* are provided for commanding the ejection of droplets of a second color, and the actuators of the third group arranged along the sides of the slot 12*c* are provided for commanding the ejection of droplets of a third color.

Figure 2:
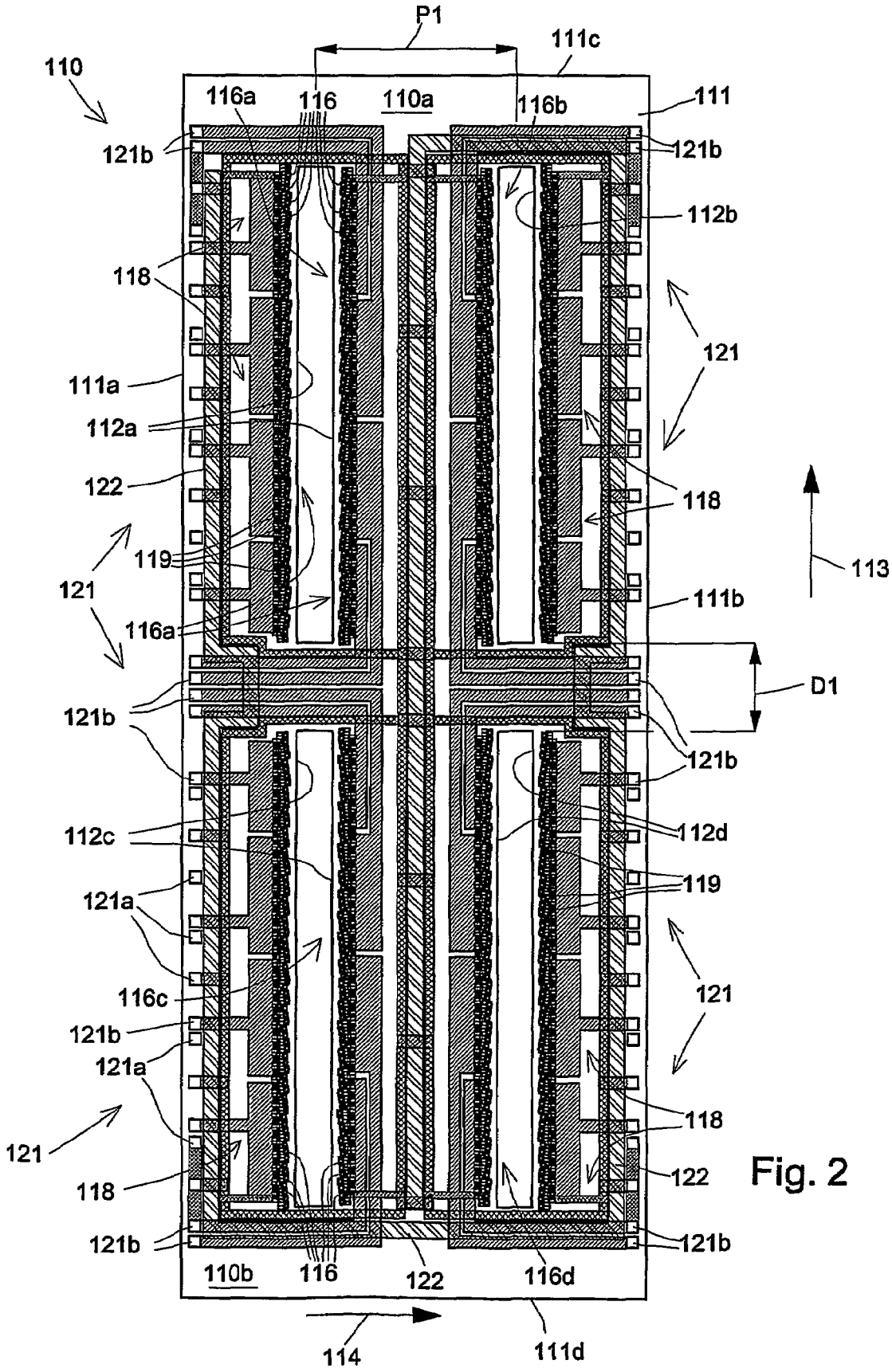
FIG. 2 is a plan view of a second embodiment of the substrate according to the invention, having four vertical slots arranged side by side and two by two in an ideal rectangle configuration.

A second embodiment of the substrate according to the invention is depicted in FIG. 2 and is generically indicated with the numeral 110.

For simplicity's sake, the parts corresponding to those already described in relation to the substrate 10 shall be designated with the same reference numerals plus 100.

The substrate 110 comprises a rectangular silicon plate 111 having two long opposite sides 111*a e* 111*b* which are oriented in a vertical direction 113, and two short sides 111*c* and 111*d* parallel to a horizontal direction 114, corresponding in turn to the motion of the substrate 110 during printing.

The substrate 110 differs from the substrate 10 in that, instead of three, it has four slots 112*a*, 112*b*, 112*c* and 112*d*, parallel to one another, extending in the lengthwise direction parallel to the vertical direction 113.

These four slots 112*a*, 112*b*, 112*c* and 112*d* are divided into an upper pair consisting of the slots 112*a* and 112*b* and are arranged in an upper semi-portion 110*a* of the substrate 110, and into a lower pair consisting of the slots 112*c* and 112*d* and arranged in a lower semi-portion 110*b* of the substrate 110.

The slots 112*a*–112*b* and the slots 112*c*–112*d* of each pair are arranged side by side and each perfectly in the shadow of the other if observed in the horizontal direction 114.

In addition, the slots 112*a* and 112*c*, just like the slots 112*b* and 112*d*, are arranged in perfect alignment if observed according to the vertical direction 113.

In this way, the slots 112*a*–112*d* define a configuration, alternative to the Y-shape configuration relative to the substrate 10, that is rectangular, in Which the upper slots 112*a* and 112*b* are staggered with respect to the lower slots 112*c* and 112*d* in the direction 113 by a distance D1, and both the upper slots 112*a*–112*b* and the lower slots 112*c*–112*d* are arranged side by side lengthwise at a same distance or step P1.

Three of the slots 112*a*–112*d* may be arranged for conveying color inks, while the remaining slot may be arranged for conveying black ink.

The substrate 110 also comprises a plurality of parts, such as actuators, drive circuits, etc . . . which are perfectly similar to those already described with reference to the substrate 10, and in particular four actuating banks 116*a*, 116*b*, 116*c* and 116*d*, each consisting of a plurality of actuators 116 arranged along both the long opposite edges of a corresponding slot, in order 112*a*, 112*b*, 112*c* and 112*d*, a plurality of drive circuits 118, and a plurality of connecting tracks 119 for connecting the drive circuits 118 with the actuators 116.

The substrate 110 also comprises a plurality of terminals 121, arranged along the sides 111*a* and 111*b*, and a plurality of tracks 122 for connecting each terminal 121 with the drive circuits 118.

The tracks 122 are normally grouped in the form of bunches and extend along the surface of the substrate 110 between terminals 121 and the drive circuits 118 according to an optimal configuration, in particular such as to occupy the lowest possible portion of surface of the substrate 110.

Similarly to the terminals 21 of the substrate 11, the terminals 121 are divided into two groups of terminals 121*a* and 121*b*, reciprocally intertwined, in order to define a grid suitable for selectively addressing, by the combination of a signal received by a given terminal 121*a* of the first group and of another signal received by a given terminal 121*b* of the second group, a given actuator 116.

For simplicity, the tracks and bunches of tracks that connect the terminals 121 with the drive circuits 118 are represented schematically with various types of dash, overlaid one on top of the other.

Functions, structural characteristics, reciprocal connections of these parts are perfectly similar to those of the corresponding parts of the substrate 11, and will not therefore be described in detail herein.

In general, the method of using the substrate 110 during the manufacturing process of a corresponding ink jet printhead is perfectly similar to the substrate 10.

Similarly to the substrate 10, the substrate 110 has the advantage, with respect to known substrates, of having the terminals 121 arranged, as stated, for receiving the external control signals intended for selectively commanding the ejection actuators 116; which are arranged in a line parallel to the direction of orientation of the slots 112*a*–112*d* and along two opposite sides on the outside of the zone of the same slots 112*a*–112*d*.

In actual fact, thanks to this arrangement of the terminals 121, it is possible to make in an optimal configuration the connection cable which, in the structure of the printhead incorporating the substrate 110, is intended for conveying control signals to the terminals 121 from the zone of the contacts for the electrical connection with the outside of the printhead.

Figure 3:
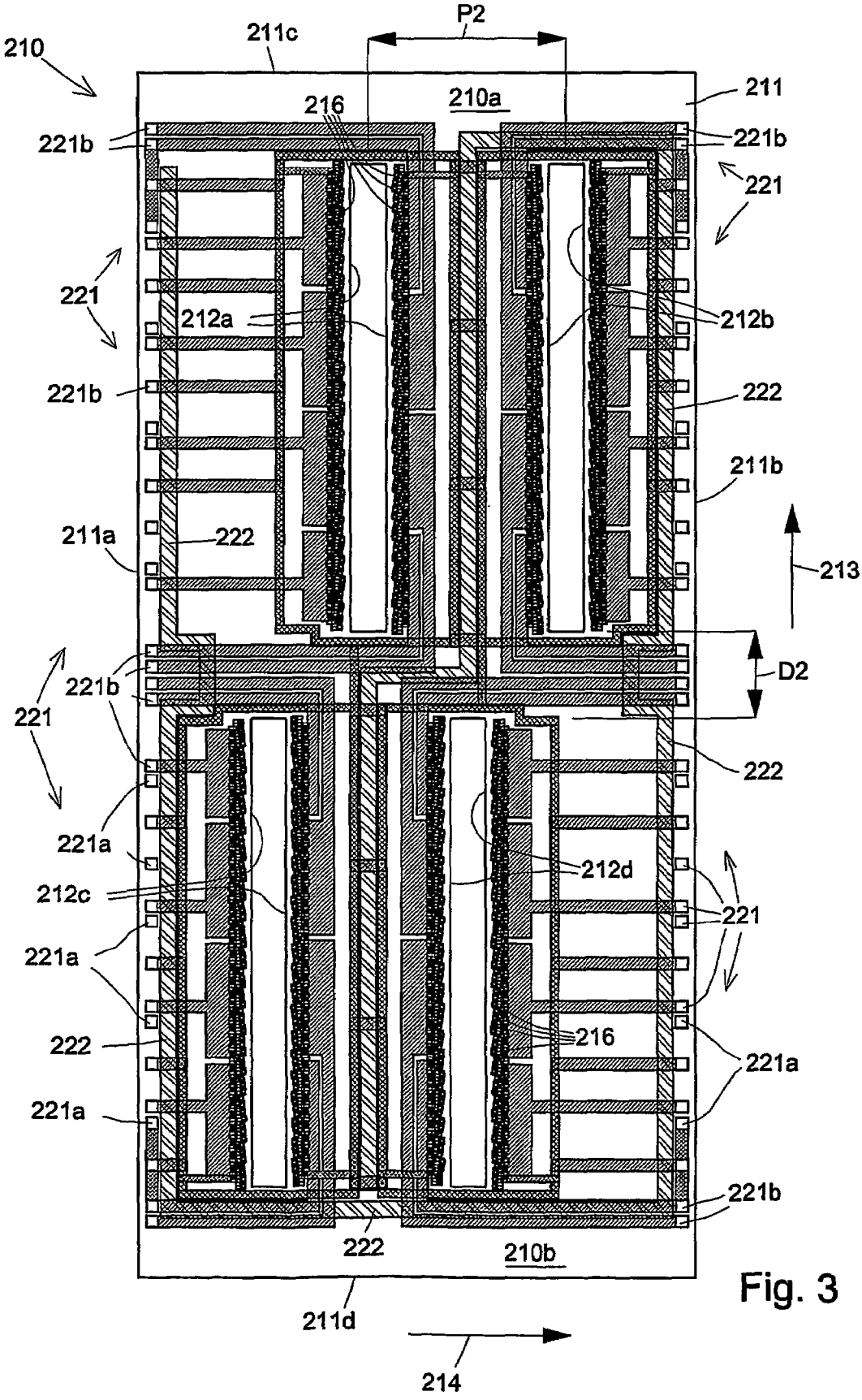
FIG. 3 is a plan view of a third embodiment of the substrate according to the invention, having four vertical slots arranged side by side and two by two in an irregular rectangle configuration.

A third embodiment of the substrate the subject of this invention is illustrated in FIG. 3 and is designated with the numeral 210.

For simplicity's sake, the parts corresponding to those relative to the first embodiment 10 of the substrate of this invention shall be designated with the same reference numerals plus 200.

The substrate 210 comprises a rectangular silicon plate 211 having two long opposite sides 211*a* and 211*b* which are oriented in a vertical direction 213, and two short sides 211*c* and 211*d* oriented in a horizontal direction 214, corresponding in turn to the motion of the substrate 210 during printing.

The substrate 210 also comprises four slots 212*a*, 212*b*, 212*c* and 212*d*, which extend parallel to one another lengthwise according to the vertical direction 213.

These four slots 212*a*, 212*b*, 212*c* and 212*d* are divided into an upper pair consisting of the slots 212*a* and 212*b* and arranged in an upper semi-portion 210*a* of the substrate 210, and into a lower pair consisting of the slots 212*c* and 212*d* and arranged in a lower semi-portion 210*b* of the substrate 210.

Similarly to the substrate 110, the slots 212*a*–212*b* and the slots 212*c*–212*d* of each pair are disposed side by side and each perfectly in the shadow of the other, if observed in the horizontal direction 114 but, unlike the substrate 110, the slots 212*a*–212*b* of the upper pair and the slots 212*c*–212*d* of the lower pair are disposed, if observed according to the vertical direction 113, staggered by a distance equal to about half of the step P2 between the slots of each pair.

In this way, the slots 212*a*–212*d* define a staggered rectangular type configuration, alternative to both the Y-shape configuration of the substrate 10 and the perfectly symmetrical and rectangular configuration of the substrate 110.

In particular the upper slots 212*a* and 212*b* are staggered with respect to the lower slots 212*c* and 212*d* in the direction 213 by a distance D2, and furthermore, as already said, the upper slots 212*a*–212*b* and the lower slots 212*c*–212*d* are arranged reciprocally staggered in the direction 214 by a distance equal to about half of their step P2.

The substrate 210 also comprises other parts such as actuating banks consisting of a plurality of ejection actuators, drive circuits, terminals, connecting tracks, etc . . . which are perfectly similar to those already described with reference to the preceding embodiments.

In particular the substrate 210 comprises a plurality of actuators 216 arranged along the edges of the four slots 212*a*–212*d* and a corresponding plurality of terminals 221 arranged in a line along the two sides 211*a* and 211*b*, accordingly parallel to the direction of extension of the slots 212*a*–212*d*, in which these terminals 221 are adapted for receiving the external signals for selectively addressing and driving the actuators 216.

Similarly to the substrates 10 and 110, the terminals 221 of the substrate 210 are divided into two addressing groups, in accordance with a grid-type addressing structure of the actuators 216, in which the terminals of the first addressing group are indicated 221*a* and are adapted for receiving logic signals, characterized by having currents of feeble intensity, whereas the terminals belonging to the second addressing group are indicated 221*b* and are adapted for receiving power signals, characterized by currents of higher intensity.

The terminals 221*a* of the first addressing group are connected with the circuits that drive the actuators 216 through a plurality of tracks that run side by side along the surface of the substrate 210 in such a way as to define bunches of tracks designated with the numeral 222.

These bunches extend in various zones of the substrate 210 between the slots 212*a*–212*d* and between the respective actuating banks.

FIG. 1 illustrates a configuration of the substrate 210 in which the terminals 221 are arranged along the entire length of the sides 211*a* and 211*b*, and immediately adjacent to the latter-named, with the bunches 222 which are arranged slightly further back along the sides 211*a* and 211*b*, with respect to the terminals 221.

However, while remaining within the scope of this invention, other variants are possible for the substrate 210, in which for example the terminals 221 may be missing along given stretches of the sides 211*a* and 211*b*, with—in place of these—portions of the bunches 222.

In particular, by analogy with the configuration of the substrate 10, the bunch of tracks 222 may extend immediately adjacent to the side 211*a*, or to the side 211*b*, or to both the sides, along stretches having a length substantially corresponding to that of the slots 212*a*–212*d*, so as to have the terminals 221 located in the remaining zones of the sides 211*a* and 211*b* not occupied by the bunch 222.

Figure 4:
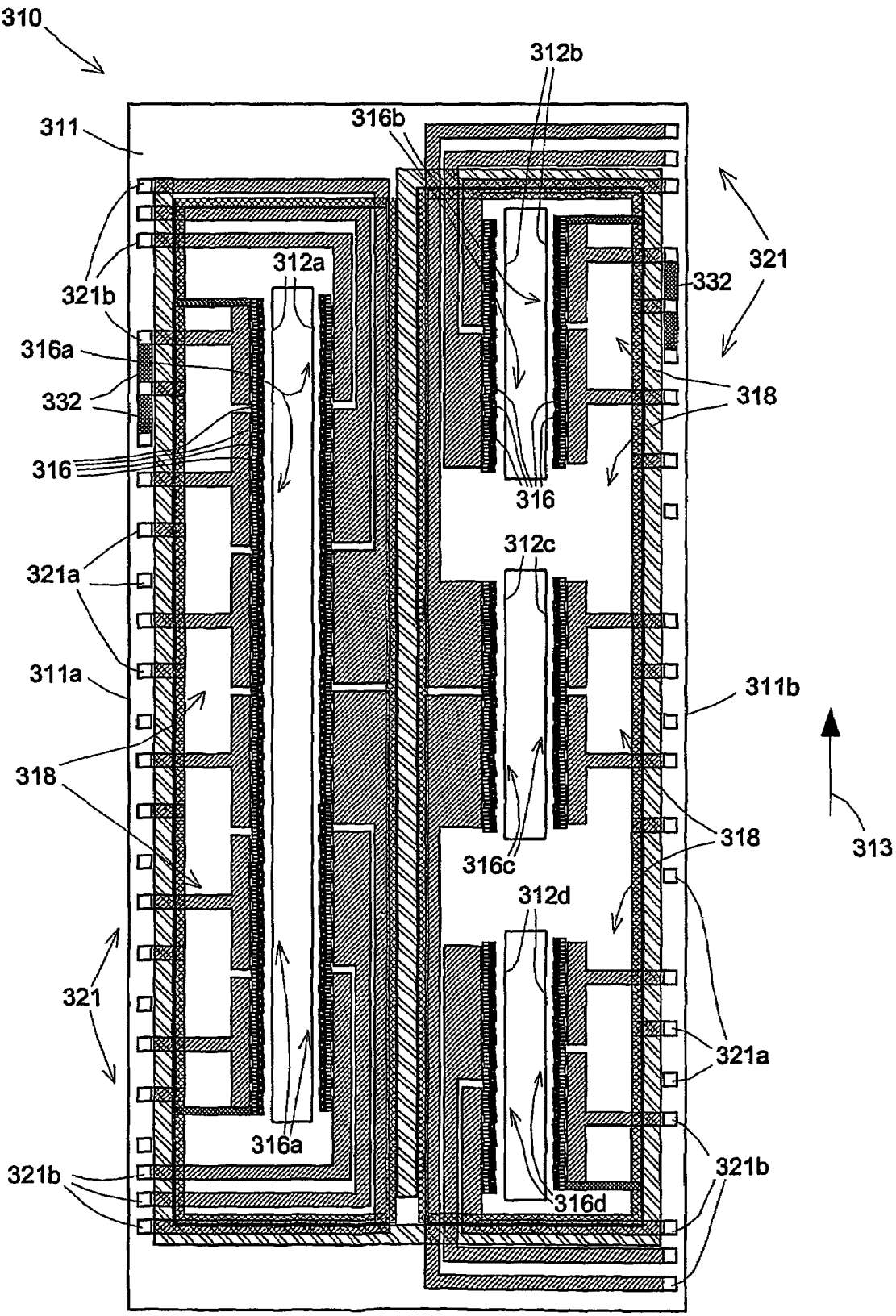
FIG. 4 is a plan view of a fourth embodiment, having one long slot and three short slots arranged in a line lengthwise beside the long slot, of the substrate for a thermal head according to the invention.

A fourth embodiment, generically designated with the numeral 310, of the substrate the subject of this invention is represented schematically in FIG. 4.

According to the format already used for the preceding cases, the parts of this fourth embodiment of the substrate corresponding to those of the first embodiment 10 shall be designated with the same reference numerals plus 300.

The substrate 310 comprises a thin rectangular plate of silicon 311 defining one right side or edge 311*a* and a left side or edge 311*b*, and which also has one long slot 312*a* arranged along a left portion of the substrate 310, and three short slots, indicated respectively with 312*b*, 312*c* and 312*d*, arranged along a left portion of the substrate 310, wherein all four slots are made through the thickness of the plate 311 and are oriented in a vertical direction 313 parallel to the sides 311*a* and 311*b*.

In particular, the three short slots 312*b*, 312*c* and 312*d* are arranged in a line among one another, alongside the right side of the long slot 312*a*.

As with the previous embodiments, a plurality of actuators 316 are arranged along the opposite sides, parallel to the direction 313, of each slot of the substrate 310, in such a way as to form four actuating banks 316*a*, 316*b*, 316*c*, and 316*d* corresponding respectively to the slots 312*a*, 312*b*, 312*c* and 312*d*.

In addition, drive circuits, indicated generically with 318 and arranged adjacent to and around the actuating banks 316*a*, 316*b*, 316*c* and 316*d* in various zones of the surface of the substrate 310, are associated with the actuators 316 for selectively controlling each one thereof.

The substrate 310 further comprises a plurality of terminals 321 which are suitable for receiving the external signals for controlling the drive circuits, and by means of the latter-named for selectively driving the actuators 316. These terminals 321 are arranged in a line along the sides 311*a* and 311*b*, i.e. according to a vertical arrangement substantially parallel to the orientation of the slots of the substrate 310 and, similarly to the previous substrates, are divided into two groups of terminals 321*a* and 321*b*, intertwined one with the other, in accordance with the grid-like structure of the drive circuits 318 so as to be able to selectively address a given actuator 116 by combining a signal sent to a given terminal 321*a* of the first group with a signal sent to a given terminal 312*b* of the second group.

Note how, in FIG. 4, the terminals 321 are disposed along the entire length of the edges 311*a* and 311*b*, without any portions of tracks or bunches of tracks interposed for connection of the terminals 321 with the drive circuits 318.

The substrate 310 further comprises a multiplicity of protecting elements 332, shown only in part in FIG. 4, whose function is to protect the circuits 318.

The long slot 312*a* is arranged for conveying a black ink, whereas the three slots 312*b*, 312*c* and 312*d* are arranged each for conveying a corresponding color ink, to the corresponding ejection actuators.

In particular, the three colors conveyed by the three slots 312*b*, 312*c* and 312*d* correspond to the three basic colors so as to enable the formation, by composition of dots printed with these colors, of color print-outs.

A substrate of this type may serve to produce a color ink jet printhead, in which the first actuating bank 316*a* consists in toto of 208 nozzles arranged in two rows side by side along the long opposite sides of the slot 312*a*, and is adapted for ejecting black ink droplets, and in which furthermore the other three actuating banks 312*b*, 312*c*, and 312*d* are each made up of 64 nozzles arranged in two rows side by side along the long opposite sides of the corresponding slot, namely 312*b*, 312*c* and 312*d*, for ejecting respectively the three basic color inks.

Other characteristics, functions, features and advantages of the substrate 310 are perfectly similar to those of the previous embodiments 10, 110, and 210 and will not therefore be described here.

It remains understood that changes and/or improvements may be made to the substrate for the manufacture of an ink jet printhead, as indeed also to the ink jet printhead incorporating the substrate described up to this point, without departing from the scope of the invention.

What is claimed is:

1. An inkjet printhead comprising a substrate, the substrate comprising:

at least three actuating banks and at least three slots of elongated shape corresponding to said three actuating banks, said at least three slots being oriented lengthwise parallel to a given vertical direction, each of said at least three slots being made through the thickness of said substrate for conveying a flow of ink to the corresponding actuating bank, each of said three actuating banks consisting in turn of a plurality of ejection actuators arranged substantially in a line along the long opposite sides of the corresponding slot, a plurality of terminals arranged on the surface of said substrate for receiving a plurality of external signals suitable for selectively addressing and driving said actuators, and a plurality of drive circuits arranged between said terminals and said actuating banks for selectively controlling, in response to the external signals received by said terminals, the ejection actuators of said three actuating banks, said drive circuits extending, around said actuating banks, along portions of the surface of said substrate, of elongated shape and substantially parallel to said at least three slots and therefore to said given vertical direction, said drive circuits being interconnected according to a grid configuration defining said terminals and such as to allow said ejection actuators to be addressed with a lesser number of terminals than that of said ejection actuators, wherein at least two of said at least three slots are arranged on the surface of said substrate one beside the other along the respective long sides, and therefore parallel to said given vertical direction, wherein said terminals associated with the drive circuits for selectively addressing and driving the ejection actuators are arranged in a zone external to said at least three slots and to said drive circuits, substantially in a line with one another parallel to said given vertical direction, and wherein a first and a second of said at least three slots are of substantially equal length and are arranged on an upper portion of said substrate, one beside the other according to a given step substantially over the entire extent of the respective long sides, parallel to said given vertical direction, so that the two actuating banks corresponding respectively to said first and to said second slot are arranged side by side on said upper portion, and wherein a third of said at least three slots is arranged, on a lower portion of said substrate, completely displaced with respect to the other two slots along said given vertical direction, according to a given distance, so that the actuating bank corresponding to said third slot is arranged on said lower portion and is displaced with respect to the other two along said vertical direction.

2. The inkjet printhead according to claim 1, wherein the third of said at least three slots, arranged in the lower portion of said substrate, is displaced with respect to the other two slots, in turn arranged in the upper portion of said substrate, along a given horizontal direction perpendicular to said given vertical direction, according to a distance equal to about half of the step between the other two slots, so that said three slots together define a Y-shape configuration on the surface of said substrate.

3. The inkjet printhead according to claim 1, further comprising in addition to said first and to said second slots arranged in the upper portion of said substrate, a third and a fourth slot substantially equal in length and arranged in the lower portion of said substrate, wherein said first, second, third and fourth slots are substantially aligned with one another two by due, both if observed along said given horizontal direction and if observed along said given vertical direction, so that the four slots together define a rectangular type configuration on the surface of said substrate.

4. The inkjet printhead according to claim 1, further comprising in addition to said first and to said second slots arranged in the upper portion of said substrate, a third and a fourth slot substantially equal in length and arranged in the lower portion of said substrate, wherein said third and fourth slots are, like said first and second slots, arranged beside one another substantially over the entire extent of the respective long sides, according to a step substantially equal to that between said first and second slot, but are however displaced, with respect to the latter, along said given horizontal direction perpendicular to said given vertical direction, by a distance equal to about half of said step, so that said four slots together define a staggered rectangular type configuration on the surface of said substrate.

5. The inkjet printhead according to claim 1 further comprising an earth network extending along the surface of said substrate and having essentially the function of conveying to the outside of said substrate the feedback currents that are generated during activation of the actuators, wherein said earth network is connected with one or more corresponding earth terminals arranged along the sides of said substrate parallel to said given vertical direction.

6. The inkjet printhead according to claim 1, further comprising a nozzle plate for the emission of droplets of ink, said nozzle plate being associated to said substrate and being provided with at least three banks of nozzles, distinct from one another, having an elongated shape and arranged parallel to a vertical direction, wherein said at least three slots are configured to convey a flow of ink to a corresponding bank of nozzles and said least three actuating banks correspond to said at least three banks of nozzles.

7. The inkjet printhead according to claim 1, wherein said terminals are arranged parallel to said given vertical direction, substantially along the entire length of said sides.

8. The inkjet printhead according to claim 1, wherein said terminals comprise a first and a second plurality of terminals arranged side by side with one another, wherein said first and said second plurality of terminals are arranged in two zones adjacent respectively to an upper end of a first and to an upper end of a second of said opposite sides of said substrate, and wherein the terminals of said first plurality are connected with the actuators arranged along a first slot, and the terminals of said second plurality are connected with the actuators arranged along a second slot.

9. An inkjet printhead comprising a substrate, the substrate comprising:

at least three actuating banks and at least three slots of elongated shape corresponding to said three actuating banks, said at least three slots being oriented lengthwise parallel to a given vertical direction, each of said at least three slots being made through the thickness of said substrate for conveying a flow of ink to the corresponding actuating bank, each of said three actuating banks consisting in turn of a plurality of ejection actuators arranged substantially in a line along the long opposite sides of the corresponding slot, a plurality of terminals arranged on the surface of said substrate for receiving a plurality of external signals suitable for selectively addressing and driving said actuators, and a plurality of drive circuits arranged between said terminals and said actuating banks for selectively controlling, in response to the external signals received by said terminals, the ejection actuators of said three actuating banks, said drive circuits extending, around said actuating banks, along portions of the surface of said substrate, of elongated shape and substantially parallel to said at least three slots and therefore to said given vertical direction, said drive circuits being interconnected according to a grid configuration defining said terminals and such as to allow said ejection actuators to be addressed with a lesser number of terminals than that of said ejection actuators, a first long slot, and three short slots parallel to one another according to said given vertical direction, wherein said three short slots are arranged substantially in a line with one another lengthwise, i.e. parallel to said given vertical direction, alongside said first long slot, wherein at least two of said at least three slots are arranged on the surface of said substrate one beside the other along the respective long sides, and therefore parallel to said given vertical direction.

wherein said terminals associated with the drive circuits for selectively addressing and driving the ejection actuators are arranged in a zone external to said at least three slots and to said drive circuits, substantially in a line with one another parallel to said given vertical direction.

10. An inkjet printhead comprising a substrate, the substrate comprising:

at least three actuating banks and at least three slots of elongated shape corresponding to said three actuating banks, said at least three slots being oriented lengthwise parallel to a given vertical direction, each of said at least three slots being made through the thickness of said substrate for conveying a flow of ink to the corresponding actuating bank, each of said three actuating banks consisting in turn of a plurality of ejection actuators arranged substantially in a line along the long opposite sides of the corresponding slot, a plurality of terminals arranged on the surface of said substrate for receiving a plurality of external signals suitable for selectively addressing and driving said actuators, and a plurality of drive circuits arranged between said terminals and said actuating banks for selectively controlling, in response to the external signals received by said terminals, the ejection actuators of said three actuating banks, said drive circuits extending, around said actuating banks, along portions of the surface of said substrate, of elongated shape and substantially parallel to said at least three slots and therefore to said given vertical direction, said drive circuits being interconnected according to a grid configuration defining said terminals and such as to allow said ejection actuators to be addressed with a lesser number of terminals than that of said ejection actuator, wherein at least two of said at least three slots are arranged on the surface of said substrate one beside the other along the respective long sides, and therefore parallel to said given vertical direction, wherein said terminals associated with the drive circuits for selectively addressing and driving the ejection actuators are arranged in a zone external to said at least three slots and to said drive circuits, substantially in a line with one another parallel to said given vertical direction, and wherein said terminals are connected with said drive circuits through a plurality of adjacent tracks forming a bunch for the transmission to the drive circuits of the signals received by the terminals, wherein said bunch extends on the surface of said substrate between said at least three slots, and in particular comprises at least a rectilinear portion which extends between the two slots which are arranged one beside the other on said upper portion of the substrate, and also parallel thereto.

11. The inkjet printhead according to claim 10, wherein said terminals are grouped in four portions, two of which are arranged along a first side of said substrate and are separated by a portion of the bunches of tracks which connect said terminals with the drive circuits, and the remaining two are arranged along the second side opposite the first of said substrate, these also being separated by a portion of the bunches of tracks.

12. The printhead according to claim 10, wherein said substrate is arranged on a front side of said head, comprising:

a plurality of contacts corresponding to said terminals for enabling the electrical connection of said printhead with the outside, and a connecting cable for connecting each of said terminals with a corresponding contact, wherein said contacts are arranged on a contact side of said printhead oriented according to a plane substantially perpendicular to said front side, said contact side being adjacent to said front side along an edge, and wherein said connecting cable extends along both said front side and said contact side and is bent in correspondence with said edge.

13. An inkjet printhead comprising a substrate, the substrate comprising:

at least three actuating banks and at least three slots of elongated shape corresponding to said three actuating banks, said at least three slots being oriented lengthwise parallel to a given vertical direction, each of said at least three slots being made through the thickness of said substrate for conveying a flow of ink to the corresponding actuating bank, each of said three actuating banks consisting in turn of a plurality of ejection actuators arranged substantially in a line along the long opposite sides of the corresponding slot, a plurality of terminals arranged on the surface of said substrate for receiving a plurality of external signals suitable for selectively addressing and driving said actuators, and a plurality of drive circuits arranged between said terminals and said actuating banks for selectively controlling, in response to the external signals received by said terminals, the ejection actuators of said three actuating banks, said drive circuits extending, around said actuating banks, along portions of the surface of said substrate, of elongated shape and substantially parallel to said at least three slots and therefore to said given vertical direction, said drive circuits being interconnected according to a grid configuration defining said terminals and such as to allow said ejection actuators to be addressed with a lesser number of terminals than that of said ejection actuators, wherein at least two of said at least three slots are arranged on the surface of said substrate one beside the other along the respective long sides, and therefore parallel to said given vertical direction, wherein said terminals associated with the drive circuits for selectively addressing and driving the ejection actuators are arranged in a zone external to said at least three slots and to said drive circuits, substantially in a line with one another parallel to said given vertical direction, wherein said terminals are arranged one beside the other along two opposite sides of said substrate, parallel to said given vertical direction and wherein said terminals are divided into a first addressing group and into a second addressing group defined by the grid structure of said drive circuits, wherein the terminals belonging to said first addressing group are electrically connected to said drive circuits via one or more bunches of adjacent tracks, and the terminals belonging to said second addressing group are each electrically connected to a plurality of terminals common to a group of actuators.

14. The inkjet printhead according to claim 13, wherein said terminals are arranged parallel to said given vertical direction, substantially along the entire length of said sides.

15. The inkjet printhead according to claim 13, wherein the tracks which connect the terminals belonging to the second addressing group to the various groups of actuators are of substantially greater thickness than the tracks that define the bunches which connect the terminals belonging to the first addressing group to said drive circuits.

16. The inkjet printhead according to claim 13, wherein said terminals belonging to said first and to said second addressing group are arranged in reciprocal alternation along said two opposite sides of said substrate.

17. The inkjet printhead according to claim 13, wherein said terminals comprise a first and a second plurality of terminals arranged side by side with one another and belonging to said second addressing group, wherein said first and said second plurality of terminals are arranged in two zones adjacent respectively to an upper end of a first and to an upper end of a second of said opposite sides of said substrate, and wherein the terminals of said first plurality are connected with the actuators arranged along a first slot, and the terminals of said second plurality are connected with the actuators arranged along a second slot.

18. The inkjet printhead according to claim 17, wherein part of the terminals of each of said first and second plurality are connected with the actuators arranged along one side of the corresponding slot, and the remaining terminals of each of said first and second plurality are connected with the actuators arranged along the opposite side of the corresponding slot.

19. The inkjet printhead according to claim 13 wherein said substrate is arranged on a front side of said head, comprising:

a plurality of contacts corresponding to said terminals for enabling the electrical connection of said printhead with the outside, and a connecting cable for connecting each of said terminals with a corresponding contact, wherein said contacts are arranged on a contact side of said printhead oriented according to a plane substantially perpendicular to said front side, said contact side being adjacent to said front side along an edge, and wherein said connecting cable extends along both said front side and said contact side and is bent in correspondence with said edge.

* * * * *